United States Patent [19]

Yashiro et al.

[11] 4,142,917

[45] Mar. 6, 1979

[54] TREATMENT OF ZINC SURFACES TO FORM A ZINC PHOSPHATE COATING

[75] Inventors: Kuniji Yashiro, Kanagawa; Shigeki Saida, Yokohama; Yoshihide Sano, Yachiyo, all of Japan

[73] Assignee: Oxy Metal Industries Corporation, Warren, Mich.

[21] Appl. No.: 836,813

[22] Filed: Sep. 26, 1977

[30] Foreign Application Priority Data

Sep. 25, 1976 [JP] Japan ..... 51-115047

[51] Int. Cl.[2] ..... C23F 7/12

[52] U.S. Cl. ..... 148/6.16; 148/6.15 Z

[58] Field of Search ..... 148/6.15 Z, 6.16

[56] References Cited

U.S. PATENT DOCUMENTS

| | | | |
|---|---|---|---|
| 2,591,479 | 4/1952 | Ward | 148/6.15 Z |
| 3,282,744 | 11/1966 | Goldsmith | 148/6.2 |
| 3,676,224 | 7/1972 | Snee | 148/6.15 Z |

FOREIGN PATENT DOCUMENTS

| | | | |
|---|---|---|---|
| 2342558 | 3/1975 | Fed. Rep. of Germany | 148/6.15 Z |
| 1415999 | 12/1975 | United Kingdom | 148/6.15 Z |

*Primary Examiner*—Ralph S. Kendall

*Attorney, Agent, or Firm*—Arthur E. Kluegel; Richard P. Mueller

[57] ABSTRACT

An improved process for forming a zinc phosphate coating on a zinc surface comprises contacting the surface with an aqueous nitrate and ammonia-free solution containing zinc, phosphate, nickel or cobalt, and hydrogen peroxide.

7 Claims, No Drawings

TREATMENT OF ZINC SURFACES TO FORM A ZINC PHOSPHATE COATING

BACKGROUND OF THE INVENTION

The present invention relates to a process for forming a phosphate coating having excellent paint adhesion and corrosion resistance on the surface of zinc or an alloy thereof without generating any sludge or waste water.

Processes for forming a phosphate coating on zinc or an alloy thereof generally comprise (1) a surface conditioning step, e.g., with colloidal titanium phosphate, (2) chemical conversion step with a phosphating solution, (3) rinsing step with water, (4) post-treatment step with a chromate solution and (5) drying step. When the zinc surface has been pretreated to provide a temporary chromate coating, the surface chromate coating is removed prior to the above-mentioned 5 steps by polishing the surface as by means of a wet buff wheel. The diluted waste of the phosphating solution from rinsing step (3) and the autodraining or periodic dumping of the chromate solution cause pollution problems. In addition, sludge formed during the chemical conversion process creates an eventual solid waste treatment or disposal problem.

A main component of sludge formed as a by-product of phosphate coating comprises $Zn_3(PO_4)_2.4H_2O$ which is the same as the main component of the phosphate coating. The formation of sludge results in part from the fact that the amount of dissolved zinc from the articles treated exceeds the amount of zinc in the deposited coating. It is also believed that the presence of nitrate catalyzes the removal of zinc from the surface and therefore increases the rate of sludge formation because of complex formation of $NH_3$ (reduced $NO_3^-$ with zinc ion.

In conventional phosphating solutions, when the amount of zinc dissolved by the above-mentioned reaction mechanism exceeds that of the zinc for forming the coating, sludge is formed.

The inventors have found that the formation of a phosphate coating can proceed relatively rapidly by using hydrogen peroxide in place of $NO_3^-$ as an oxidizing agent in the phosphating solution for zinc but the resulting coating is disadvantageous because of poor adhesion of the phosphate coating to the substrate and poor adhesion of subsequently applied paint.

SUMMARY OF THE INVENTION

It has now been found that the rate of sludge formation in a phosphating bath for forming a zinc phosphate coating on a zinc surface may be reduced by employing an aqueous treating solution free of nitrate or ammonia ions and containing 0.1 to 5 g/l zinc ion, from 5 to 50 g/l phosphate, from 0.5 to 5 g/l hydrogen peroxide and from 1 to 10 parts by weight of nickel and/or cobalt ions per part of zinc. Preferably, the coating thus applied is dried in place and then contacted with an aqueous mixed chromium composition having a ratio of hexavalent to trivalent chromium of from 2 to 10 and a pH of from 2 to 5 and dried without rinsing.

DETAILED DESCRIPTION OF THE INVENTION

Zinc ions are an essential component for forming the phosphate coating of the acidic phosphating solution according to the invention. Zinc is used in an amount ranging from 0.1 to 5 g/l. At concentrations of less than 0.1 g/l, the coating cannot be formed rapidly and at concentrations of higher than 5 g/l, the adhesion of paint film decreases.

Nickel and cobalt ions are reduced on the surface of articles to be treated to improve the adhesion of a painted film and at the same time to adjust the oxidation of the treating solution. $Ni^{2+}$ and/or $Co^{2+}$ are used in an amount ranging from 1 to 10 parts per part of $Zn^{2+}$. If the total parts of weight of $Ni^{2+}$ and $Co^{2+}$ is below this level, the adhesion of a painted film will not be improved and in an amount of higher than 10 parts, no additional improvement is observed.

Phosphate is an indispensable component to obtain phosphate coating and amount of which should be 5–50 g/l. At amounts of less than 5 g/l, the chemical conversion is too slow and at amounts of higher than 50 g/l, no further improvement is observed.

Hydrogen peroxide acts as an oxidizing agent for dissolving zinc from articles to be treated. It is used in an amount ranging from 0.5 to 5 g/l. At concentrations of less than 0.5 g/l, the chemical conversion will not proceed and at concentrations of higher than 5 g/l, the adhesion of painted film will decrease.

The phosphating solution according to the invention may be prepared by dissolving zinc oxide in a concentrated aqueous solution of phosphoric acid, then dissolving nickel carbonate and/or cobalt carbonate into the solution, adjusting the acidity of the solution, making up to a predetermined concentration by diluting with water and then adding hydrogen peroxide in a predetermined amount.

In the phosphating process according to the invention, articles to be treated are contacted with the treating solution by flooding or spraying the solution on the surface at a temperature of from 50 to 75 degrees C. for a duration of from 1 to 5 seconds, followed by removing excess solution by means of an air knife or squeeze rolls, drying the coated articles or stopping the reactions by rinsing with water to provide the phosphate coating.

In the treating solution at 55 degrees C., the acid ratio ranges suitably from 12 to 15 but it is not always limited within the range depending on the type and surface conditions of articles to be treated. At a treating temperature of less than 50 degrees C., the reaction rate will be slow and at a temperature of higher than 75 degrees C., zinc will be dissolved excessively from the articles to be treated to cause the formation of sludge.

For a duration of contact of shorter than 1 second, the chemical conversion will have not been completed and a duration of longer than 5 seconds is not required as the chemical conversion has been completed in 5 seconds.

If articles to be treated contain aluminum, lead or the like as impurities or alloy components, the treating solution may be suitably modified by adding a fluoride or complexed fluoride.

In conventional rinsing steps with a chromate solution applied for the sealing, a portion of the phosphate coating is dissolved and $Zn^{2+}$ and $PO_4^{3-}$ are accumulated in the chromate rinsing solution.

Such accumulation of $Zn^{2+}$ and $PO_4^{3-}$ in the rinse solution causes an increase in the pH of the rinsing solution and the formation of a precipitate of $Cr^{3+}$ which is deleterious to the rinse solution. In order to prevent such accumulation, the rinse solution is conventionally either automatically drained or replenished by discarding the exhausted solution. Either technique necessitates waste treatment.

The aqueous chromate solutions preferably used in the invention contain hexavalent and trivalent chromium compounds in a $Cr^{6+}/Cr^{3+}$ ratio ranging from 2 to 10 and have a pH value of from 2 to 5. The total amount of $Cr^{6+}$ and $Cr^{3+}$ to be contained in the solution depends on the amount of solution to be applied on the surface and the desired amount of chromium to be deposited on the articles but normally ranges from 0.2 to 50 g/l. The solution may contain other additives such as a simple fluoride, complex fluoride or $Zn^{2+}$ in addition to chromium. The aqueous chromate solution may be prepared in any known manner such as by dissolving a compound containing chromium trioxide and reducing partially the chromium trioxide with either a lower alcohol such as methyl or ethyl alcohol or an organic acid such as formic acid, oxalic acid or the like.

The amount of the aqueous chromate solution to be applied according to the invention ranges from 0.5 to 10 g/m$^2$, preferably from 1 to 5 g/m$^2$. At amounts of less than 0.5 g/m$^2$, uniform application is difficult and at amounts beyond 10 g/m$^2$, drying time is unduly lengthened.

The invention will be now illustrated by way of the following examples

EXAMPLE 1

Hot galvanized steel sheets having a thickness of 0.35 mm, a width of 50 mm and a length of 250 mm were polished by a wet buff wheel to remove chromate on the surface, dried and then weighed ($W_0$). The sheets were then treated with an aqueous suspension of colloidal titanium phosphate in a concentration of 1 g/l and warmed at 60 degrees C. for 2 seconds by spraying. Immediately thereafter, the sheets were squeezed through squeeze rolls and were contacted with an acidic phosphating solution at 68 degrees C. containing 1.00 g/l of $Zn^{2+}$, 2.95 g/l of $Ni^{2+}$, 14.8 g/l of $PO_4^{3-}$ and 2.00 g/l of $H_2O_2$ and having a total acid/free acid ratio of 7.6 by flooding the solution at a rate of about 150 ml/second for 1, 2, 4 or 8 seconds, followed by squeezing through squeeze rolls, drying and weighing ($W_1$). To measure coating weight, the coated sheets were then immersed in a solution containing 49 parts of 28% aqueous $NH_3$, 49 parts of water and 2 parts of chromic acid at 25 degrees C. for 15 minutes to dissolve the coatings, rinsed with water, dried and weighed ($W_2$).

Table 1 shows the results and shows also the results of a comparative example in which Example 1 was repeated except that an acidic phosphating solution containing 2.46 g/l of $Zn^{2+}$, 9.00 g/l of $PO_4^{3-}$, 2.70 g/l of $NO_3^-$, 2.00 g/l of $SiF_6^{2-}$, 0.25 g/l of $F^-$ and 2.00 g/l of starch phosphate and having a total acid/free acid ratio of 8.0 was used.

TABLE 1

| Phosphate Solution | Contact Time Sec. | Coating Weight g/m$^2$ | Zinc in Coating g/m$^2$ | Zinc Dissolved from galvanized coating g/m$^2$ | Net Zinc Build-up in Phosphate Bath g/m$^2$ |
|---|---|---|---|---|---|
| Example 1 | 1 | 1.20 | 0.52 | 0.48 | −0.04 |
| " | 2 | 1.51 | 0.64 | 0.59 | −0.05 |
| " | 4 | 1.53 | 0.65 | 0.60 | −0.05 |
| " | 8 | 1.51 | 0.64 | 0.61 | −0.03 |
| Comparative Example 1 | 1 | 0.05 | 0.02 | 0.31 | 0.29 |
| " | 2 | 0.31 | 0.13 | 0.45 | 0.32 |
| " | 4 | 1.24 | 0.53 | 0.68 | 0.15 |
| " | 8 | 1.55 | 0.66 | 0.73 | 0.07 |

EXAMPLES 2-11

The chromate coating was removed from the surface of hot-galvanized steel sheets having a thickness of 0.35 mm, a width of 200 mm and a length of 300 mm by polishing them by means of a wet buff wheel. The polished surface was then treated with a suspension of a colloidal titanium phosphate surface conditioner at 60 degrees C. in a concentration of 1 g/l by spraying for 2 seconds. The treated surface was passed through squeeze rolls immediately thereafter and then contacted with an aqueous acidic phosphoric acid solution at 68 degrees C. having the compositions as specified in Table 2 by flooding the solution at a rate of about 1000 ml/second. Immediately after contact with the solution, the sheets were passed through squeeze rolls and then dried by hot air for Examples 2 through 5 and 7 through 11 and Comparative Example 2 or rinsed with water for Example 6 and Comparative Example 3.

The sheets dried without rinsing were coated with an aqueous solution having a ratio of $Cr^{6+}/Cr^{3+}$ of 3, a pH of 2.6 and a total chromium content of 5 g/l obtained by reacting 130 parts of chromium trioxide with 8 parts of methanol in an aqueous solution to reduce the hexavalent chromium partially, the coating being carried out in an amount of about 2 ml/m$^2$ at room temperature.

For Example 6 and Comparative Example 3, the phosphated surface was water rinsed and then treated with a chromium solution as above at a total chromium concentration of 2 g/l at 60 degrees C. by spraying. After removing excess solution by means of squeeze rolls, the rinsed sheets were dried in hot air.

Table 3 shows results obtained by subjecting the surface-treated sheets to the salt spray test according to JIS Z-2371. For reference, the weight of the coatings and amount of chromium deposited are also shown in Table 3. Thus treated sheets were also coated with a paint of two-coat, two-bake type for colored galvanized steel sheet (KP Color 2105 available from Kansai Paints Co.) to a total film thickness of 18 microns. Thus painted sheets were subjected to the bending adhesion test about a diameter equal to the thickness of two sheets (2T). In another group of the thus painted sheets, the paint film was scribed by means of a NT cutter and the cross-hatched surface was then subjected to the salt spray test according to JIS Z-2371. Results obtained are shown in Table 3.

TABLE 2

| | Composition of treating solution, g/l | | | | | | | Acid | Contact Time, | Rinsing After |
|---|---|---|---|---|---|---|---|---|---|---|
| | $Zn^{2+}$ | $Ni^{2+}$ | $Co^{2+}$ | $PO_4^{3-}$ | $H_2O_2$ | $BF_4^-$ | $F^-$ | Ratio | Sec. | Conversion |
| Example | | | | | | | | | | |

TABLE 2-continued

| | Composition of treating solution, g/l | | | | | | | Acid Ratio | Contact Time, Sec. | Rinsing After Conversion |
|---|---|---|---|---|---|---|---|---|---|---|
| | $Zn^{2+}$ | $Ni^{2+}$ | $Co^{2+}$ | $PO_4^{3-}$ | $H_2O_2$ | $BF_4^-$ | $F^-$ | | | |
| 2 | 1.00 | 3.00 | — | 14.8 | 2.00 | — | — | 7.6 | 2 | No |
| 3 | 1.00 | 2.00 | 1.00 | 14.8 | 2.00 | — | — | 7.6 | 2 | No |
| 4 | 1.00 | — | 3.00 | 14.8 | 2.00 | — | — | 7.6 | 2 | No |
| 5 | 2.30 | 6.20 | — | 28.6 | 1.10 | 4.50 | — | 6.3 | 2 | No |
| 6 | 2.30 | 6.20 | — | 28.6 | 1.10 | 4.50 | — | 6.3 | 2 | Yes |
| 7 | 2.30 | 4.10 | 2.10 | 28.6 | 1.10 | 4.50 | — | 6.3 | 2 | No |
| 8 | 2.30 | — | 6.20 | 28.6 | 1.10 | 4.50 | — | 6.3 | 2 | No |
| 9 | 1.00 | 3.00 | — | 14.8 | 2.00 | — | 0.25 | 6.5 | 2 | No |
| 10 | 1.00 | 2.00 | 1.00 | 14.8 | 2.00 | — | 0.25 | 6.5 | 2 | No |
| 11 | 1.00 | — | 3.00 | 14.8 | 2.00 | — | 0.25 | 6.5 | 2 | No |
| Comparative Example | | | | | | | | | | |
| 2 Same as Comparative Example 1 | | | | | | | | | 8 | No |
| 3 Same as Comparative Example 1 | | | | | | | | | 8 | Yes |

TABLE 3

| | Coating Weight $g/m^2$ | Weight of deposited chromium, —$mg/m^2$ | Salt-Spray Corrosion Resistance 48 hours —% rusted area | Bend Adhesion —% peeled | Painted Sheet Salt Spray Corrosion resistance 1000 Hrs. —min creepage |
|---|---|---|---|---|---|
| Example | | | | | |
| 2 | 1.51 | 10.3 | 0 | No change | 0 |
| 3 | 1.46 | 13.8 | 0 | No change | 0 |
| 4 | 1.48 | 9.6 | 0 | No change | 0.5 |
| 5 | 1.62 | 14.2 | 0 | No change | 0.5 |
| 6 | 1.58 | 11.1 | 0 | No change | 0.5 |
| 7 | 1.64 | 10.5 | 0 | No change | 0 |
| 8 | 1.60 | 12.4 | 0 | No change | 0 |
| 9 | 1.37 | 10.8 | 0 | No change | 0.5 |
| 10 | 1.48 | 9.2 | 0 | No change | 0 |
| 11 | 1.38 | 13.0 | 0 | No change | 0 |
| Comparative Example | | | | | |
| 2 | 1.55 | 11.2 | 40 | No change | 2 - 5 |
| 3 | 1.52 | 11.8 | 15 | No change | 1 |

What is claimed is:

1. A process for forming a zinc phosphate coating on a zinc or zinc alloy surface comprising contacting the surface with an aqueous solution free of nitrate and ammonia and consisting essentially of

| | |
|---|---|
| 0.1 to 5 g/l | zinc ion |
| 5 to 50 g/l | phosphate |
| 0.5 to 5 g/l | hydrogen peroxide |
| 1 to 10 parts | nickel or cobalt ion per part of zinc |

and thereafter drying the coating and then contacting the coated surface with an aqueous chromium solution without an intervening rinse step.

2. The process of claim 1 wherein the aqueous phosphate solution exhibits a temperature of from 50 to 75 degrees C. upon contact.

3. The process of claim 2 wherein the duration of contact with the phosphate solution is at least 1 second.

4. The process of claim 1 wherein the aqueous chromium solution comprises hexavalent and trivalent chromium in a weight ratio of from 2 to 10:1 and exhibits a pH value of from 2 to 5.

5. The process of claim 4 wherein the total chromium content of the chromium solution ranges from 0.2 to 50 g/l.

6. The process of claim 1 wherein the aqueous chromium solution is dired without an intervening rinse step to yield a coating weight of chromium of from 1 to 50 $mg/m^2$.

7. The process of claim 1 wherein the aqueous chromium solution treatment effects an applied liquid coating of from 0.5 to 10 $g/m^2$.

* * * * *